US010386156B2

(12) United States Patent
Shorter

(10) Patent No.: US 10,386,156 B2
(45) Date of Patent: Aug. 20, 2019

(54) FIREARM HOLDING APPARATUS

(71) Applicant: James C Shorter, Flowery Branch, GA (US)

(72) Inventor: James C Shorter, Flowery Branch, GA (US)

( * ) Notice: Subject to any disclaimer, the term of this patent is extended or adjusted under 35 U.S.C. 154(b) by 0 days.

(21) Appl. No.: 16/250,952

(22) Filed: Jan. 17, 2019

(65) Prior Publication Data

US 2019/0219361 A1 Jul. 18, 2019

Related U.S. Application Data

(63) Continuation-in-part of application No. 29/633,969, filed on Jan. 17, 2018, now Pat. No. Des. 844,320.

(60) Provisional application No. 62/618,195, filed on Jan. 17, 2018.

(51) Int. Cl.

| | |
|---|---|
| ***A45F 3/04*** | (2006.01) |
| ***F41C 33/04*** | (2006.01) |
| ***A41F 3/00*** | (2006.01) |
| ***F41C 33/02*** | (2006.01) |
| ***F42B 39/02*** | (2006.01) |

(52) U.S. Cl.

CPC ..... *F41C 33/048* (2013.01); *A41F 3/00* (2013.01); *F41C 33/0209* (2013.01); *F42B 39/02* (2013.01)

(58) Field of Classification Search

CPC ..... A45F 2003/146; A45F 2003/148; F41C 33/046; F41C 33/048; F41C 33/0209

See application file for complete search history.

(56) References Cited

U.S. PATENT DOCUMENTS

| | | | | | |
|---|---|---|---|---|---|
| 5,361,953 | A | * | 11/1994 | Nichols | F41C 33/0227 224/192 |
| D411,916 | S | * | 7/1999 | Jackson | D3/218 |
| D467,417 | S | * | 12/2002 | Jackson | D3/218 |
| D561,464 | S | * | 2/2008 | Courtney | D3/218 |
| D595,930 | S | * | 7/2009 | Perry | D2/626 |
| 2004/0217141 | A1 | * | 11/2004 | Brooks | A45F 5/021 224/587 |
| 2012/0085802 | A1 | * | 4/2012 | Ferrante | F41C 33/046 224/587 |
| 2019/0070442 | A1 | * | 3/2019 | Jacob | A62B 35/0018 |

* cited by examiner

*Primary Examiner* — Adam J Waggenspack

(57) ABSTRACT

A firearm holding apparatus that is used to conceal and hold a firearm underneath clothing such as, but not limited to, a jacket or coat is provided. Additionally, the firearm holding apparatus can be used as a pair of suspenders in order to hold up a pair of pants or trousers. The firearm holding apparatus comprises a first strap, a second strap, a firearm holster, and an ammunition pouch. The first strap and the second form a harness which allows the user to wear the firearm holding apparatus around his or her shoulders. The firearm holster is a designed to hold a firearm. The ammunition pouch is designed to hold ammunition for a firearm.

20 Claims, 9 Drawing Sheets

FIREARM HOLDING APPARATUS

The current application is a continuation-in-part (CIP) application of the U.S. design application Ser. No. 29/633,969 filed on Jan. 17, 2018. The current application claims a priority to the U.S. Provisional Patent application Ser. No. 62/618,195 filed on Jan. 17, 2018.

FIELD OF THE INVENTION

The present invention relates generally to apparel. More particularly, the present invention is a firearm holding apparatus. The present invention allows a user to easily and comfortably conceal a firearm and a means to hold up a pair of trousers or similar. The present invention includes a holster that can be attached to the pair of suspenders. The present invention additionally includes a magazine or bullet holder allowing a user to carry ammunition for a firearm.

BACKGROUND OF THE INVENTION

There is always room innovation when dealing with the field of apparel. In particular, there exists apparel which aids in holding up trousers or similar. One type of apparel which aids in holding up trousers or similar is a pair of suspenders. Suspenders includes various means to attach to a pair of trousers or similar. The most common means is the use of clips to attach to a pair of trousers or similar. Suspenders are usually chosen by an individual to hold up trousers or similar because they can be easily concealed by a jacket. The concealment aspect of trousers allows the room to attach other items which an individual may also want to conceal. In particular, and item which may also want to be concealed is a holster. A holster provides a compartment to carry and conceal a firearm and by attaching a holster to a pair of suspenders, an individual can conceal the holster therefore concealing the firearm. There exists a need for an invention which combines a pair of suspenders and a holster allowing a user to easily and comfortably carry and conceal a firearm.

It is therefore an objective of the present invention to provide suspenders with holster. The present invention includes a holster that can be attached to the suspenders. The user can utilize the suspenders as just suspenders, the holster as just a holster when the holster is detached. The present invention allows a user to easily and comfortably conceal a firearm and a means to hold up a pair of trousers or similar. The present invention additionally includes a magazine or bullet holder allowing a user to carry ammunition for a firearm.

DETAIL DESCRIPTIONS OF THE INVENTION

Figure 1:
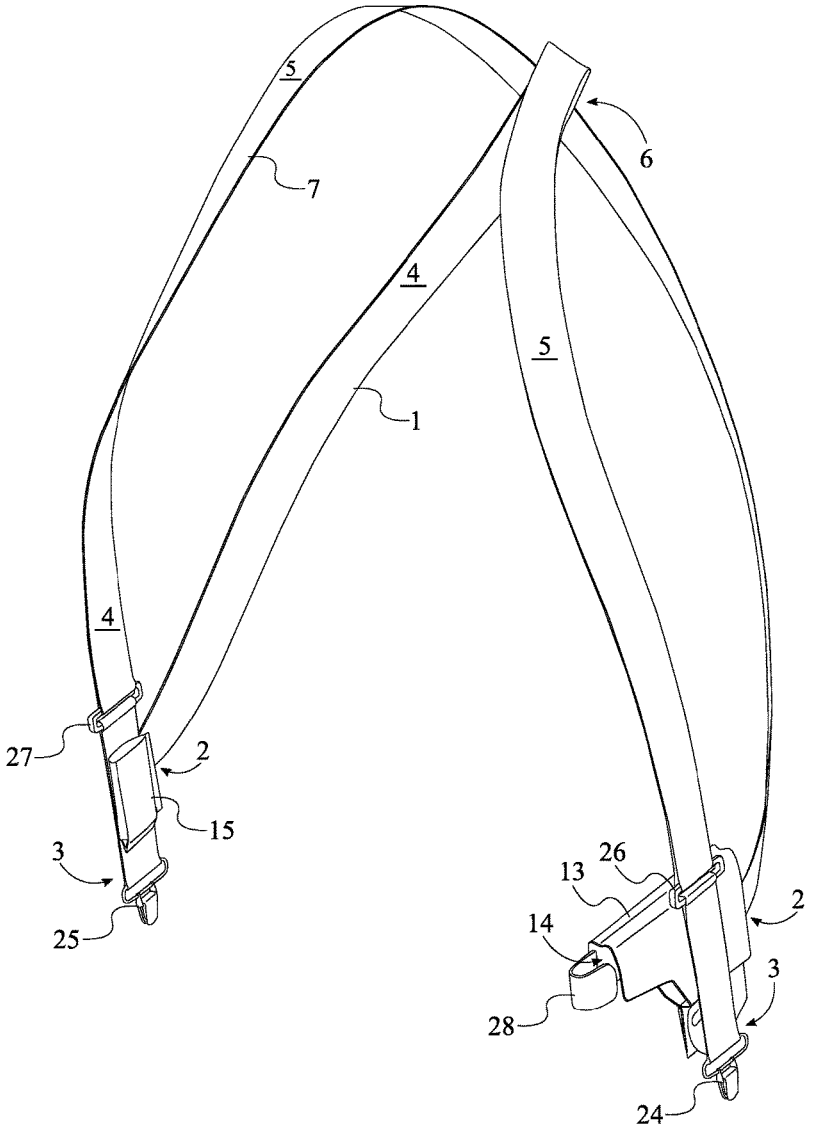
FIG. 1 is a front perspective view of the present invention.

All illustrations of the drawings are for the purpose of describing selected versions of the present invention and are not intended to limit the scope of the present invention.

In reference to FIGS. 1 through 9, the present invention is a firearm holding apparatus that is used to conceal and hold a firearm underneath clothing such as, but not limited to, a jacket or coat. Additionally, the present invention can be used as a pair of suspenders in order to hold up a pair of pants or trousers. The present invention comprises a first strap 1, a second strap 7, a firearm holster 13, and an ammunition pouch 15. The first strap 1 and the second strap 7 form a harness which allows the user to wear the present invention around his or her shoulders. The firearm holster 13 is a designed to hold a firearm. Preferably, the firearm holster 13 is designed to hold a pistol, but the firearm holster 13 may be designed to hold any type of firearm such as, but not limited to, a rifle or sub-machine firearm. The ammunition pouch 15 is designed to hold ammunition for a firearm. The ammunition pouch 15 may be designed to hold any type of ammunition of a firearm such as, but not limited to, pistol or rifle ammunition.

Figure 2:
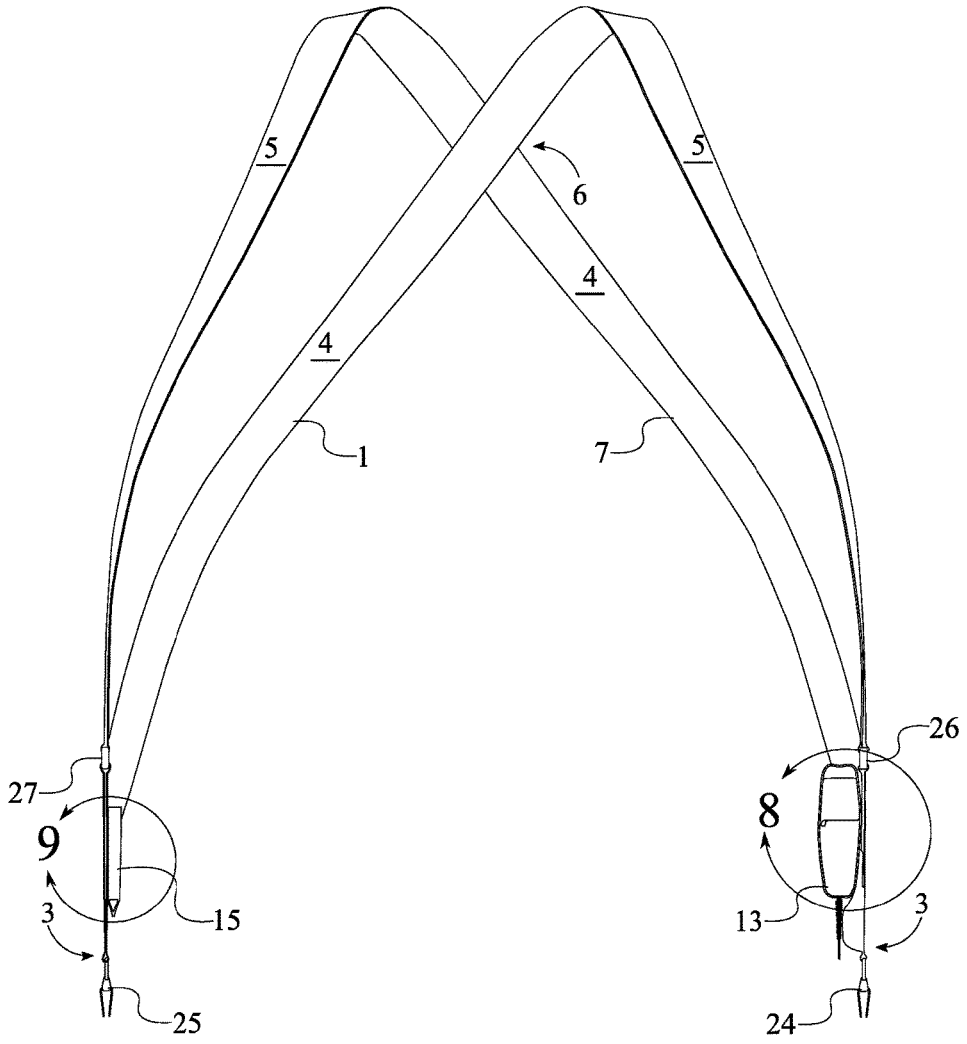
FIG. 2 is a front view of the present invention.
Figure 3:
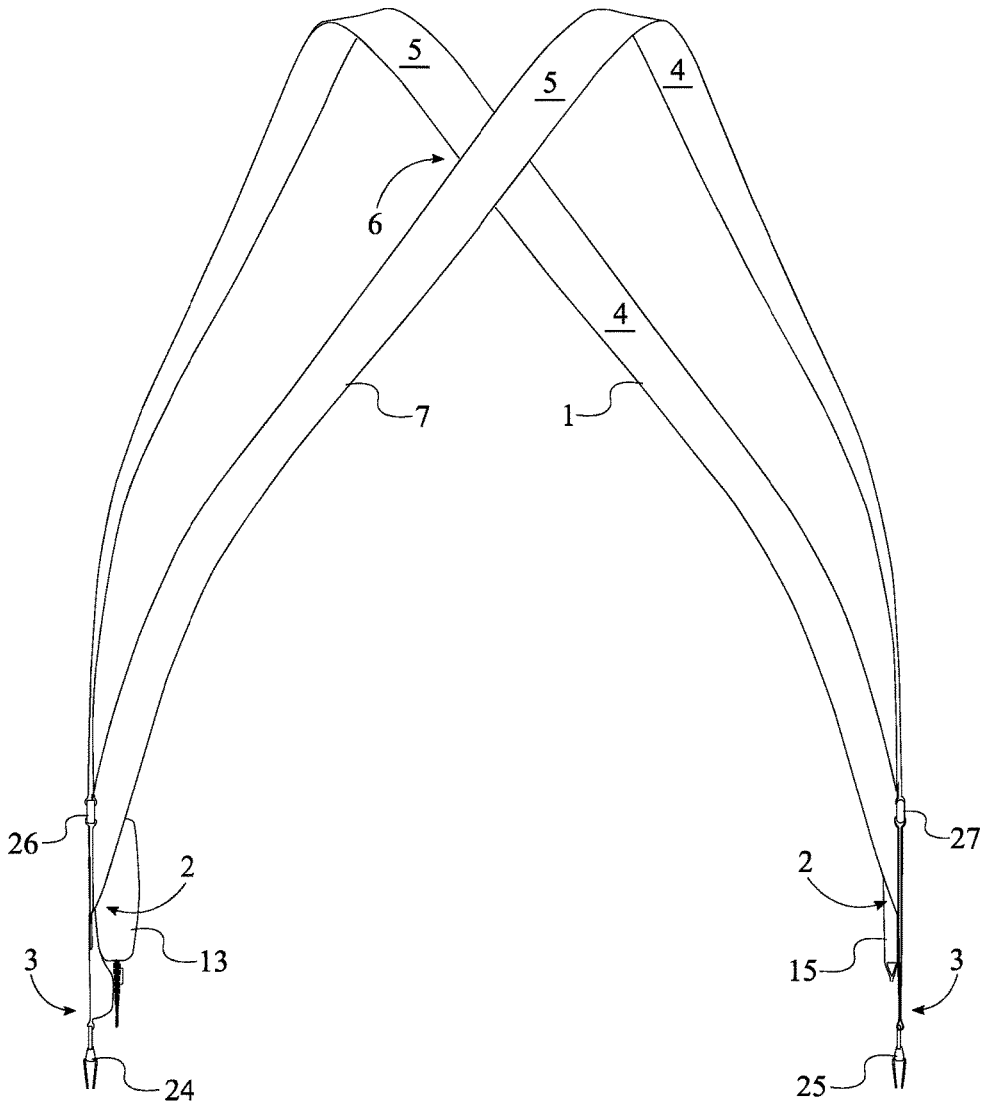
FIG. 3 is a rear view of the present invention.

The general configuration of the aforementioned components allows the present invention to effectively conceal and hold a firearm and ammunition for said firearm and to hold up a pair of pants or trousers. With reference to FIGS. 1 through 3, the first strap 1 and the second strap 7 each comprise a fixed end 2, a free end 3, an inner elongated surface 4, an outer elongated surface 5, and an intersection point 6. The fixed end 2 of the first strap 1 is connected in between the inner elongated surface 4 of the second strap 7 and the outer elongated surface 5 of the second strap 7. The fixed end 2 of the first strap 1 is preferably stitched onto the second strap 7. Additionally, the fixed end 2 of the first strap 1 is positioned adjacent to the free end 3 of the second strap 7. Similarly, the fixed end 2 of the second strap 7 is connected in between the inner elongated surface 4 of the first strap 1 and the outer elongated surface 5 of the first strap 1. The fixed end 2 of the second strap 7 is preferably stitched to the first strap 1. The fixed end 2 of the second strap 7 is positioned adjacent to the free end 3 of the first strap 1. The intersection point 6 of the first strap 1 is positioned between the fixed end 2 of the first strap 1 and the free end 3 of the first strap 1. The intersection point 6 of the second strap 7 is positioned between the fixed end 2 of the second strap 7 and the free end 3 of the second strap 7. The intersection point 6 of the first strap 1 is connected to the intersection point 6 of the second strap 7. The intersection point 6 of the first strap 1 is preferably stitched to the intersection point 6 of the second strap 7. This arrangement forms a harness with the first strap 1 and the second strap 7 in order for the user to wear the present invention around his or her shoulders. When the present invention is worn, the intersection point 6 is positioned at the backside of the user similar to traditional suspenders. The firearm holster 13 is attached onto the inner elongated surface 4 of the first strap 1 and is positioned adjacent to the free end 3 of the first strap 1. This arrangement positions the firearm holster 13 in order for the firearm holster 13 to be concealed and held in place when the present invention is worn under clothing. Additionally, this arrangement allows the user to freely remove or attach the firearm holster 13 to the first strap 1 when desired. In more detail, the firearm holster 13 may be used as just a holster when detached from the first strap 1. Similarly, the ammunition pouch 15 is attached onto the inner elongated surface 4 of the second strap 7 and is positioned adjacent to the free end 3 of the second strap 7. This arrangement positions the ammunition pouch 15 in order for the ammunition pouch 15 to be concealed and held in place when the present invention is worn under clothing. Additionally, this arrangement allows the user to freely remove or attach the ammunition pouch 15 to the second strap 7 when desired. In more detail, the ammunition pouch 15 may be used as just a holder for ammunition when detached from the second strap 7.

Figure 4:
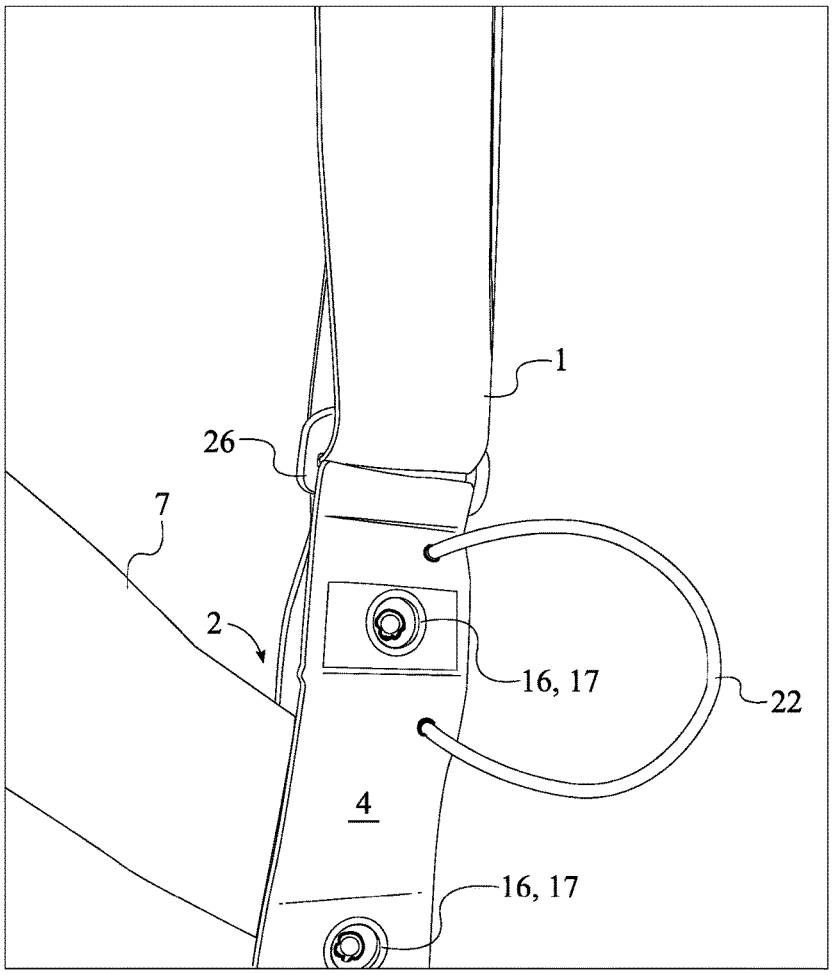
FIG. 4 is a side perspective view of the first strap of the present invention showing the elastic firearm restraint and the at least one distal interlocking portion.
Figure 8:
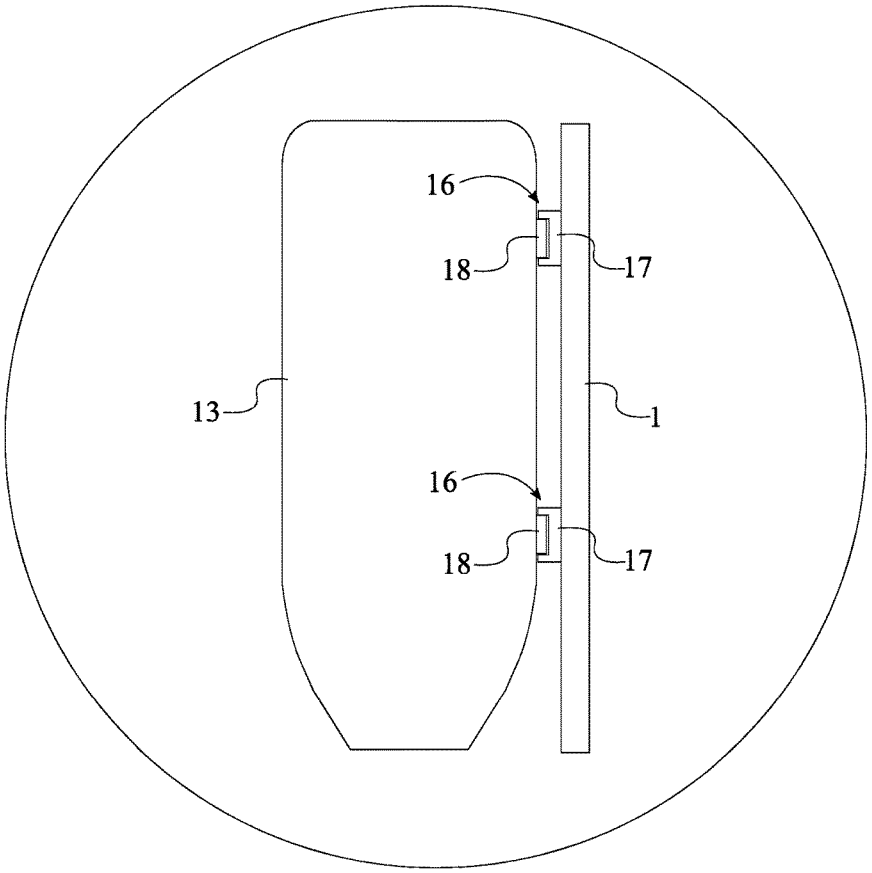
FIG. 8 is a detailed schematic diagram of circle 8 in FIG. 2 showing the attachment between the firearm holster and the first strap.

With reference to FIGS. 4 and 8, the present invention may further comprise a first fastener 16. The first fastener 16 is used to attach the firearm holster 13 to the first strap 1. The first fastener 16 may be any type of fastener, but preferably is a snap fastener. The first fastener 16 comprises at least one distal interlocking portion 17 and at least one proximal interlocking portion 18. The at least one distal interlocking portion 17 is connected onto the inner elongated surface 4 of the first strap 1 and is positioned adjacent to the free end 3 of the first strap 1. Moreover, the at least one proximal interlocking portion 18 is connected onto the firearm holster 13. This arrangement positions the first fastener 16 within the present invention in order to properly attach the firearm holster 13 to the first strap 1.

Figure 7:
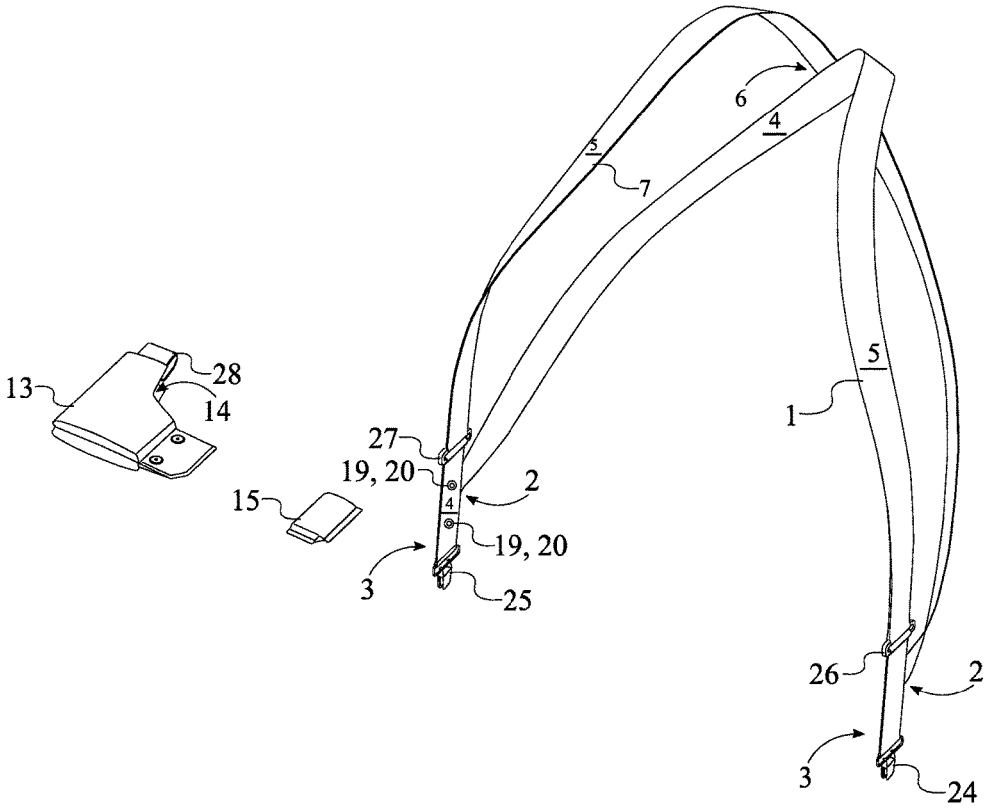
FIG. 7 is front perspective view of the present invention showing firearm holster and the ammunition pouch being detached.
Figure 9:
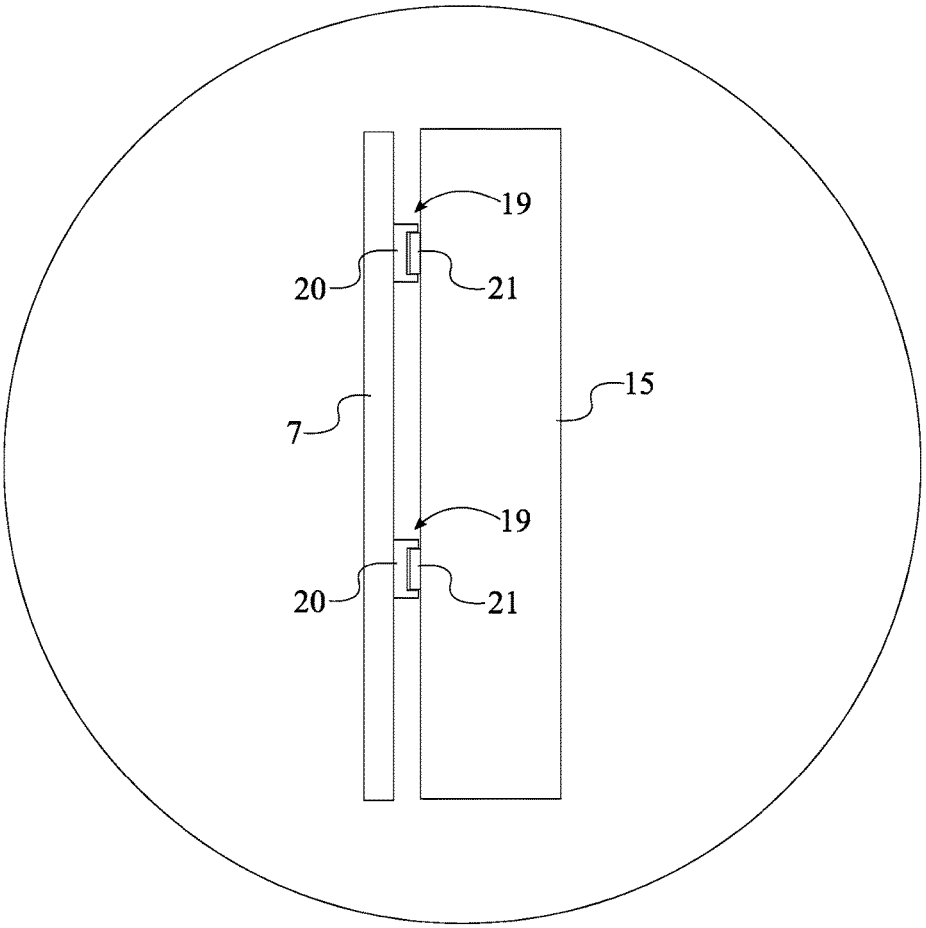
FIG. 9 is a detailed schematic diagram of circle 9 in FIG. 2 showing the attachment between the ammunition pouch and the second strap.

With reference to FIGS. 7 and 9, the present invention may further comprise a second fastener 19. The second fastener 19 is used to attach the ammunition pouch 15 to the second strap 7. Similarly to the first fastener 16, the second fastener 19 may be any type of fastener, but preferably is a snap fastener. The second fastener 19 comprises at least one distal interlocking portion 20 and at least one proximal interlocking portion 21. The at least one distal interlocking portion 20 is connected onto the inner elongated surface 4 of the second strap 7 and is positioned adjacent to the free end 3 of the second strap 7. Moreover, the at least one proximal interlocking portion 21 is connected onto the ammunition pouch 15. This arrangement positions the second fastener 19 within the present invention in order to properly attach the ammunition pouch 15 to the second strap 7. Optionally, the ammunition pouch 15 can be attached to the firearm holster 13 through the at least one proximal interlocking portion 18 of the first fastener 16 and the at least one proximal interlocking portion 21 of the second fastener 19.

Figure 5:
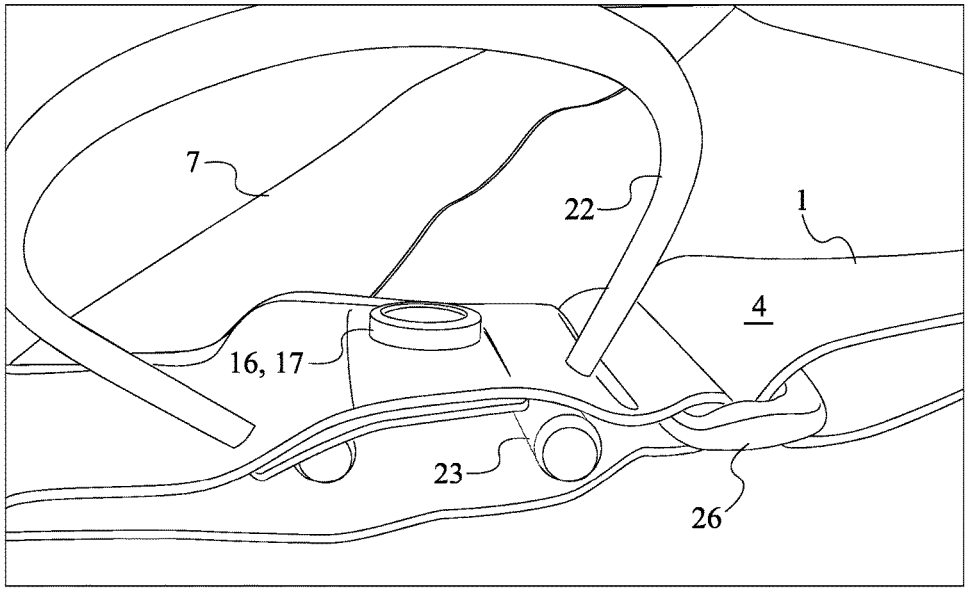
FIG. 5 top side perspective view of the first strap of the present invention showing the at least one restraint adjuster.
Figure 6:
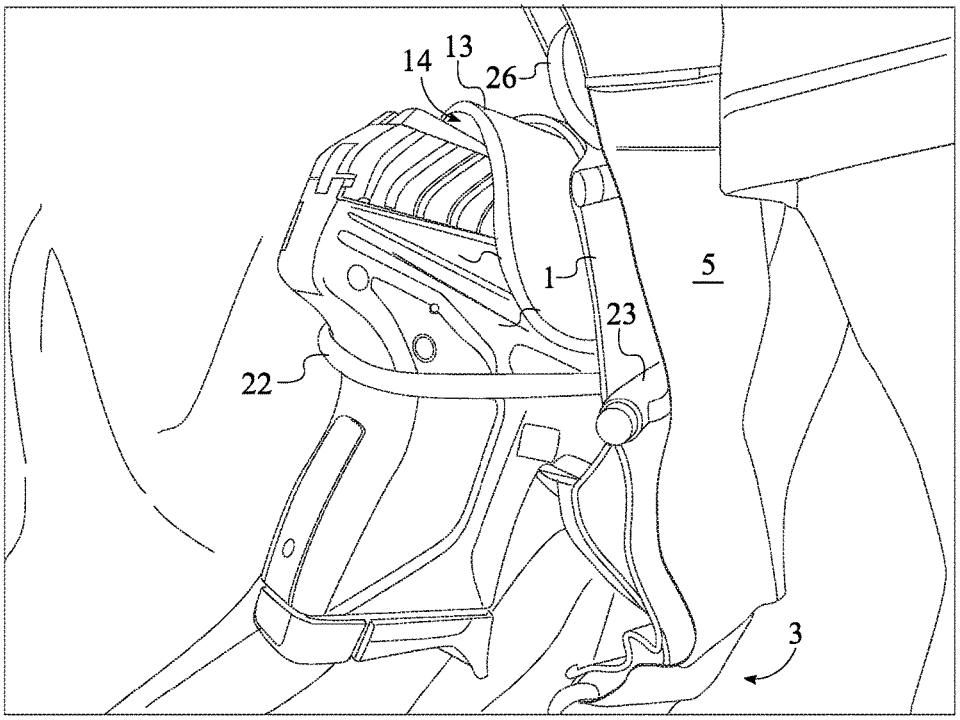
FIG. 6 is a perspective view showing a firearm within the firearm holster when the present invention is worn by a user.

With reference to FIGS. 4 through 6, the present invention may further comprise an elastic firearm restraint 22. The elastic firearm restraint 22 is used to restrain a firearm within the firearm holster 13 when the firearm holster 13 is attached to the first strap 1. In more detail, the elastic firearm restraint 22 is pulled around the firearm when the firearm is inside of the firearm holster 13. The elastic firearm restraint 22 is connected along the first strap 1 and attached across an opening 14 of the firearm holster 13. This arrangement positions the elastic firearm restraint 22 to properly restrain a firearm within the firearm holster 13. In more detail, this arrangement allows the elastic firearm restraint 22 to pulled around the firearm, when inside of the firearm holster 13, in order to prevent the firearm from falling out of the firearm holster 13 and to hold the firearm in place.

With reference to FIGS. 5 and 6, the present invention may further comprise at least one restraint adjuster 23. The at least one restraint adjuster 23 is used to adjust the elastic firearm restraint 22 in order to properly restrain a certain type of firearm within the firearm holster 13. The at least one restraint adjuster 23 is operatively integrated along the elastic firearm restraint 22. Moreover, the at least one restraint adjuster 23 is used to elongate or shorten a total length of the elastic firearm restraint 22. This allows the elastic firearm restraint 22 to be adjusted in order to restraint firearms of different sizes and designs.

With reference to FIG. 1, the present invention may further comprise a first clip 24. The first clip 24 is used to attach the first strap 1 onto a pair of pants or trousers. The first clip 24 is hingedly connected to the free end 3 of the first strap 1. This arrangement positions the first clip 24 in order for the first strap 1 to properly be attached onto a pair of pants or trousers. Additionally, the hinged connection between the first clip 24 and the first strap 1 allows the user to easily position the first clip 24 to attach the first strap 1 to a pair of pants or trousers.

With reference to FIG. 1, the present invention may further comprise a second clip 25. Similarly to the first clip 24, the second clip 25 is used to attach the second strap 7 onto a pair of pants or trousers. The second clip 25 is hingedly connected to the free end 3 of the second strap 7. This arrangement positions the second clip 25 in order for the second strap 7 to properly be attached onto a pair of pants or trousers. Additionally, the hinged connection between the second clip 25 and the second strap 7 allows the user to easily position the second clip 25 to attach the second strap 7 to a pair of pants or trousers.

With reference to FIG. 1, the present invention may further comprise a first strap adjuster 26. The first strap adjuster 26 is used to adjust the first strap 1 in order for the loop of the first strap 1 to be fitted well around a shoulder of the user. The first strap adjuster 26 is operatively integrated along the first strap 1. Moreover, the first strap adjuster 26 is used to elongate or shorten a total length of the first strap 1. This arrangement allows the user to tighten or loosen the first strap 1 in order for the first strap 1 to be fitted well around a shoulder of the user.

With reference to FIG. 1, the present invention may further comprise a second strap adjuster 27. Similarly to the first strap adjuster 26, the second strap adjuster 27 is used to adjust the second strap 7 in order for the loop of the second strap 7 to be fitted well around a shoulder of the user. The second strap adjuster 27 is operatively integrated along the second strap 7. Moreover, the second strap adjuster 27 is used to elongate or shorten a total length of the second strap 7. This arrangement allows the user to tighten or loosen the second strap 7 in order for the second strap 7 to be fitted well around a shoulder of the user.

With reference to FIGS. 1 and 7, the present invention may further comprise a foldable firearm restraint 28. The foldable firearm restraint 28 is used to restraint a firearm within the firearm holster 13 when the firearm holster 13 is detached from the first strap 1. The foldable firearm restraint 28 is connected adjacent to the firearm holster 13 and is positioned across an opening 14 of the firearm holster 13. This arrangement allows the foldable firearm restraint 28 to prevent a firearm from falling out of the firearm holster 13 and to hold the firearm in place.

With reference to FIG. 7, the present invention may be used as a means to hold up a pair of pants or trousers when the firearm holster 13 and the ammunition pouch 15 are detached from first strap 1 and the second strap 7, respectively. Hence, the first strap 1 and the second strap 7 are configured into a pair of wearable suspenders.

The present invention may be used by left-hand dominant or right-hand dominant users. For right-hand dominant users, the first strap 1 is positioned at the left side of the user in order to easily access the firearm holster 13 from the left-hand side of the user. For left-hand dominant users, the first strap 1 is positioned at the right side of the user in order to easily access the firearm holster 13 from the right-hand side of the user.

In another embodiment of the present invention, the present invention may further comprise an elastic loop. The elastic loop is a secondary means to attach the ammunition pouch 15 to the second strap 7. The elastic loop is connected along the second strap 7 and attached across the ammunition pouch 15. This arrangement allows the elastic loop to properly secure the ammunition pouch 15 to the second strap 7.

Although the invention has been explained in relation to its preferred embodiment, it is to be understood that many other possible modifications and variations can be made without departing from the spirit and scope of the invention as hereinafter claimed.

What is claimed is:

1. A firearm holding apparatus comprises:
a first strap;
a second strap;
a firearm holster;
an ammunition pouch;
the first strap and the second strap each comprise a fixed end, a free end, an inner elongated surface, an outer elongated surface, and an intersection point;
the fixed end of the first strap being connected in between the inner elongated surface of the second strap and the outer elongated surface of the second strap;
the fixed end of the first strap being positioned adjacent to the free end of the second strap;
the fixed end of the second strap being connected in between the inner elongated surface of the first strap and the outer elongated surface of the first strap;
the fixed end of the second strap being positioned adjacent to the free end of the first strap;
the intersection point of the first strap is positioned between the fixed end of the first strap and the free end of the first strap;
the intersection point of the second strap is positioned between the fixed end of the second strap and the free end of the second strap;
the intersection point of the first strap is connected to the intersection point of the second strap;
the firearm holster being attached onto the inner elongated surface of the first strap, such that a firearm holding portion of the holster is located along the inner elongated surface;
the firearm holster being positioned adjacent to the free end of the first strap;
the ammunition pouch being attached onto the inner elongated surface of the second strap; and
the ammunition pouch being positioned adjacent to the free end of the second strap.

2. The firearm holding apparatus as claimed in claim 1 comprises:
a first fastener;
the first fastener comprises at least one distal interlocking portion and at least one proximal interlocking portion;
the at least one distal interlocking portion being connected onto the inner elongated surface of the first strap;
the at least one distal interlocking portion being positioned adjacent to the free end of the first strap; and
the at least one proximal interlocking portion being connected onto the firearm holster.

3. The firearm holding apparatus as claimed in claim 1 comprises:
a second fastener;
the second fastener comprises at least one distal interlocking portion and at least one proximal interlocking portion;
the at least one distal interlocking portion being connected onto the inner elongated surface of the second strap;
the at least one distal interlocking portion being positioned adjacent to the free end of the second strap; and
the at least one proximal interlocking portion being connected onto the ammunition pouch.

4. The firearm holding apparatus as claimed in claim 1 comprises:
an elastic firearm restraint;
the elastic firearm restraint being connected along the first strap; and
the elastic firearm restraint being attached across an opening of the firearm holster.

5. The firearm holding apparatus as claimed in claim 4 comprises:
at least one restraint adjuster; and
the at least one restraint adjuster being operatively integrated along the elastic firearm restraint, wherein the at least one restraint adjuster is used to elongate or shorten a total length of the elastic firearm restraint.

6. The firearm holding apparatus as claimed in claim 1 comprises:
a first clip; and
the first clip being hingedly connected to the free end of the first strap.

7. The firearm holding apparatus as claimed in claim 1 comprises:
a second clip; and
the second clip being hingedly connected to the free end of the second strap.

8. The firearm holding apparatus as claimed in claim 1 comprises:
a first strap adjuster; and
the first strap adjuster being operatively integrated along the first strap, wherein the first strap adjuster is used to elongate or shorten a total length of the first strap.

9. The firearm holding apparatus as claimed in claim 1 comprises:
a second strap adjuster; and
the second strap adjuster being operatively integrated along the second strap, wherein the second strap adjuster is used to elongate or shorten a total length of the second strap.

10. The firearm holding apparatus as claimed in claim 1 comprises:
a foldable firearm restraint;
the foldable firearm restraint being connected adjacent to the firearm holster; and
the foldable firearm restraint being positioned across an opening of the firearm holster.

11. The firearm holding apparatus as claimed in claim 1 comprises:
the first strap and the second strap being configured into a pair of wearable suspenders.

12. A firearm holding apparatus comprises:
a first strap;
a second strap;
a firearm holster;
an ammunition pouch;
a first clip;
a second clip;

the first strap and the second strap each comprise a fixed end, a free end, an inner elongated surface, an outer elongated surface, and an intersection point;

the fixed end of the first strap being connected in between the inner elongated surface of the second strap and the outer elongated surface of the second strap;

the fixed end of the first strap being positioned adjacent to the free end of the second strap;

the fixed end of the second strap being connected in between the inner elongated surface of the first strap and the outer elongated surface of the first strap;

the fixed end of the second strap being positioned adjacent to the free end of the first strap;

the intersection point of the first strap is positioned between the fixed end of the first strap and the free end of the first strap, such that a firearm holding portion of the holster is located along the inner elongated surface;

the intersection point of the second strap is positioned between the fixed end of the second strap and the free end of the second strap;

the intersection point of the first strap is connected to the intersection point of the second strap;

the firearm holster being attached onto the inner elongated surface of the first strap;

the firearm holster being positioned adjacent to the free end of the first strap;

the ammunition pouch being attached onto the inner elongated surface of the second strap;

the ammunition pouch being positioned adjacent to the free end of the second strap;

the first clip being hingedly connected to the free end of the first strap; and the second clip being hingedly connected to the free end of the second strap.

13. The firearm holding apparatus as claimed in claim 12 comprises:

a first fastener;

the first fastener comprises at least one distal interlocking portion and at least one proximal interlocking portion;

the at least one distal interlocking portion being connected onto the inner elongated surface of the first strap;

the at least one distal interlocking portion being positioned adjacent to the free end of the first strap; and the at least one proximal interlocking portion being connected onto the firearm holster.

14. The firearm holding apparatus as claimed in claim 12 comprises:

a second fastener;

the second fastener comprises at least one distal interlocking portion and at least one proximal interlocking portion;

the at least one distal interlocking portion being connected onto the inner elongated surface of the second strap;

the at least one distal interlocking portion being positioned adjacent to the free end of the second strap; and the at least one proximal interlocking portion being connected onto the ammunition pouch.

15. The firearm holding apparatus as claimed in claim 12 comprises:

an elastic firearm restraint;

the elastic firearm restraint being connected along the first strap; and the elastic firearm restraint being attached across an opening of the firearm holster.

16. The firearm holding apparatus as claimed in claim 15 comprises:

at least one restraint adjuster; and the at least one restraint adjuster being operatively integrated along the elastic firearm restraint, wherein the at least one restraint adjuster is used to elongate or shorten a total length of the elastic firearm restraint.

17. The firearm holding apparatus as claimed in claim 12 comprises:

a first strap adjuster; and the first strap adjuster being operatively integrated along the first strap, wherein the first strap adjuster is used to elongate or shorten a total length of the first strap.

18. The firearm holding apparatus as claimed in claim 12 comprises:

a second strap adjuster; and the second strap adjuster being operatively integrated along the second strap, wherein the second strap adjuster is used to elongate or shorten a total length of the second strap.

19. The firearm holding apparatus as claimed in claim 12 comprises:

a foldable firearm restraint;

the foldable firearm restraint being connected adjacent to the firearm holster; and the foldable firearm restraint being positioned across an opening of the firearm holster.

20. The firearm holding apparatus as claimed in claim 12 comprises:

the first strap and the second strap being configured into a pair of wearable suspenders.

* * * * *